US008066577B2

(12) United States Patent
Chen et al.

(10) Patent No.: US 8,066,577 B2
(45) Date of Patent: Nov. 29, 2011

(54) INFANT SWING

(75) Inventors: Hong-Bo Chen, Taipei (TW); Chih-Wei Wang, Taipei (TW)

(73) Assignee: Excellerate Enterprise Co., Ltd., Songshan District, Taipei (TW)

( * ) Notice: Subject to any disclaimer, the term of this patent is extended or adjusted under 35 U.S.C. 154(b) by 380 days.

(21) Appl. No.: 12/179,589

(22) Filed: Jul. 25, 2008

(65) Prior Publication Data

US 2009/0029786 A1 Jan. 29, 2009

Related U.S. Application Data

(60) Provisional application No. 60/951,714, filed on Jul. 25, 2007, provisional application No. 60/986,292, filed on Nov. 8, 2007.

(51) Int. Cl.
*A63G 9/16* (2006.01)

(52) U.S. Cl. ..... 472/119; 472/118

(58) Field of Classification Search ..... 472/119, 472/118

See application file for complete search history.

(56) References Cited

U.S. PATENT DOCUMENTS 4,150,820 A 4/1979 Bochmann
4,687,456 A * 8/1987 Wang ..... 446/158
5,376,053 A 12/1994 Ponder
6,347,830 B1 2/2002 Chen
6,692,368 B1 2/2004 Hyun
6,702,685 B2 * 3/2004 Mahlstedt et al. ..... 472/118
6,705,950 B2 3/2004 Wood
6,896,624 B2 5/2005 Longenecker
7,258,618 B2 * 8/2007 Haut ..... 472/119
7,275,996 B2 10/2007 Dillner
7,381,138 B2 * 6/2008 Dillner et al. ..... 472/119
7,909,738 B2 * 3/2011 Chen ..... 482/27
2005/0075181 A1 4/2005 Paesang
2007/0049389 A1 3/2007 Paesang
2007/0207870 A1 9/2007 Armbruster

FOREIGN PATENT DOCUMENTS

GB 2399769 A 9/2004

* cited by examiner

*Primary Examiner* — Gene Kim
*Assistant Examiner* — Michael Dennis
(74) *Attorney, Agent, or Firm* — Winston Hsu; Scott Margo

(57) ABSTRACT

Infant swing has a front leg frame and a rear leg frame pivoting to each other and connecting to a seat assembly via a driving module at the pivot between the front leg frame and the rear leg frame for swinging the seat back and forth. Two protection guards are mounted and connected between the front leg frame and the rear leg frame for preventing the toddler from being harmed when reaching his/her hands out between the frame and the seat as the toddler sits in the seat and swings relative to the frame. A battery assembly that provides power for the driving module is configured at the bottom of the frame for effectively lowering the center of gravity of the infant swing and providing higher stability. Skidproof foot assemblies mounting at the elbows of the front leg frame and the rear leg frame can further provide stability and integrity.

17 Claims, 10 Drawing Sheets

INFANT SWING

CROSS REFERENCE TO RELATED APPLICATIONS

This application claims the benefit of U.S. Provisional Applications No. 60/951,714, which was filed on Jul. 25, 2007, and No. 60/986,292, which was filed on Nov. 8, 2007, and are incorporated herein by reference.

BACKGROUND OF THE INVENTION

1. Field of the Invention

The present invention relates to an infant swing, and more specifically, to an infant swing having protection guards connecting between front leg frame and rear leg frame and having a battery assembly configured at the bottom of the frame body that increases stability and safety protection.

2. Description of the Prior Art

Infant swings at the present time provide extra functional mechanism or devices in addition to the seat assembly. FIG. 1 shows that an infant swing 1 includes a frame body 10 and a seat 50, where the frame body 10 includes a stand comprised by two front legs 11 and two rear legs 12, two connecting devices 17, and a front leg cross rod 13 and a rear leg cross rod 14. The upper ends of the two front legs 11 connect to the upper ends of the two rear legs 12, each via the connecting device 17. The front leg cross rod 13 connects between the two front legs 11 and the rear leg cross rod 14 connects between the two rear legs 12. Additionally, the frame body 11 further includes a driving module and a folding module. The driving module provides the seat 50 with the ability to swing back and forth relative to the frame body 10 and the folding module can simplify the folding operation when the infant swing 1 needs to transport or store. In the embodiment in FIG. 1, both the driving module and the folding module are configured inside the connecting devices 17 and not shown in the figure. For further providing power source for the driving module, a battery assembly is also designed into the frame body 10, or more precisely, in the connecting devices 17 of the embodiment in FIG. 1. The seat 50 can then be propelled to swing by two hanging arms 40 that pivotally connect to the connecting devices 17 and droved by the driving module.

Since the driving module and the battery assembly are some components with heavy mass, the overall center of gravity of the infant swing 1 has been raised to a higher position when the driving module and the battery assembly are configured at the connecting devices 17. Such configuration decreases the stability of the infant swing 1. On the other hand, the infant swing 1 in the prior art shows no proper protection guards between the hanging arms 40 and the front legs 11 and the rear legs 12. An infant seated in the seat 50 may harm himself when reaching his hands out the hanging arms 40 during swinging of the seat 50 relative to the frame body 10.

SUMMARY OF THE INVENTION

The present invention provides an infant swing. The infant swing comprises a frame body comprising a front leg frame and a rear leg frame capable of pivoting to each other, a seat assembly for supporting a seat and swingly connecting to the frame body, and a driving module configured at the pivot of the front leg frame and the rear leg frame and connecting to the seat assembly for driving the seat assembly to swing relative to the frame body.

The present invention also provides an infant swing. The infant swing comprises a frame body comprising a front leg frame and a rear leg frame capable of pivoting to each other, a seat assembly for supporting a seat and swingly connecting to the frame body, a driving module configured at the pivot of the front leg frame and the rear leg frame and connecting to the seat assembly for driving the seat assembly to swing relative to the frame body, and a battery assembly configured at one of said leg frames and electrically connecting to the driving module for providing power to the driving module to swing the seat assembly.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
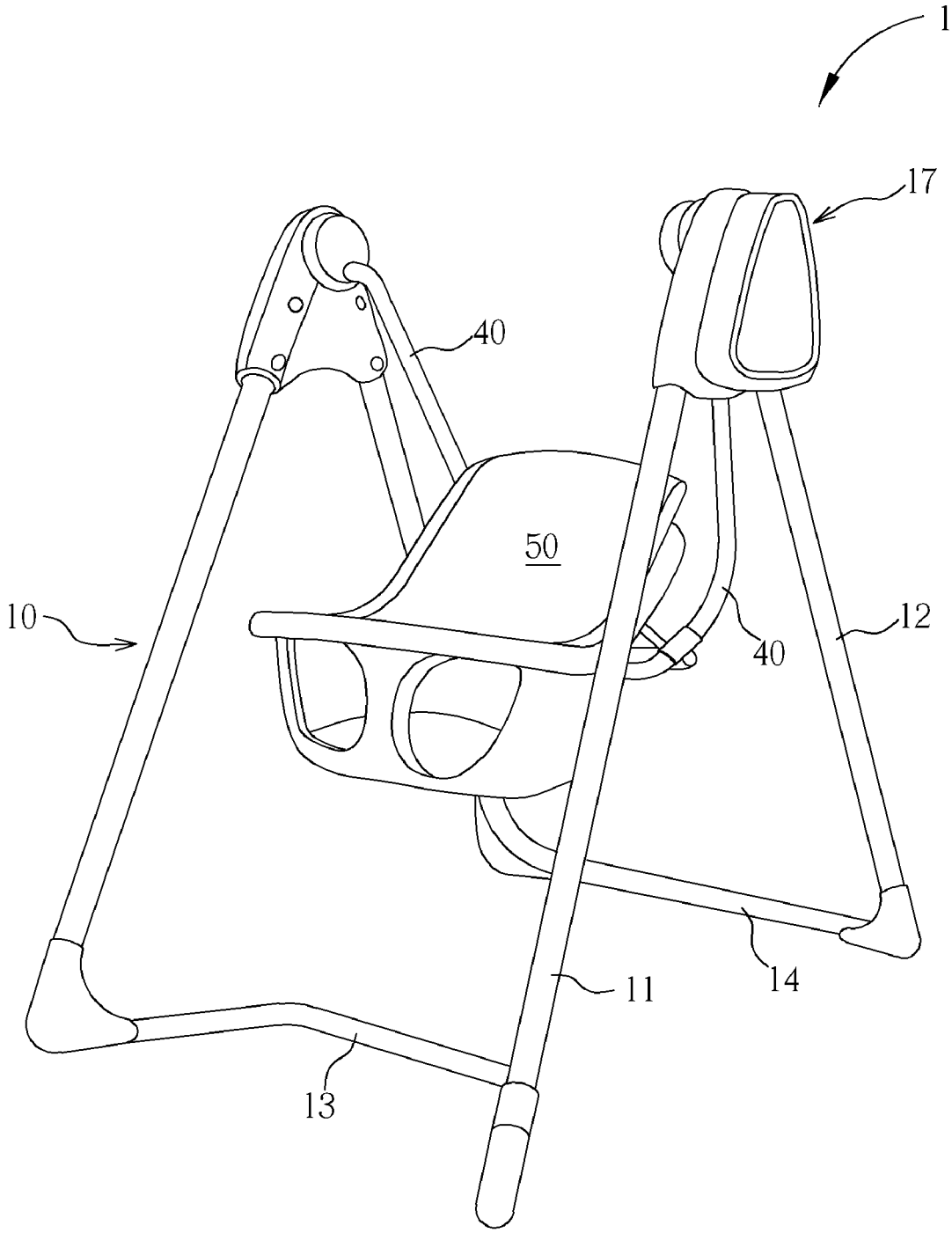
FIG. 1 PRIOR ART
FIG. 1 is an illustration of an infant swing according to the prior art.
Figure 2:
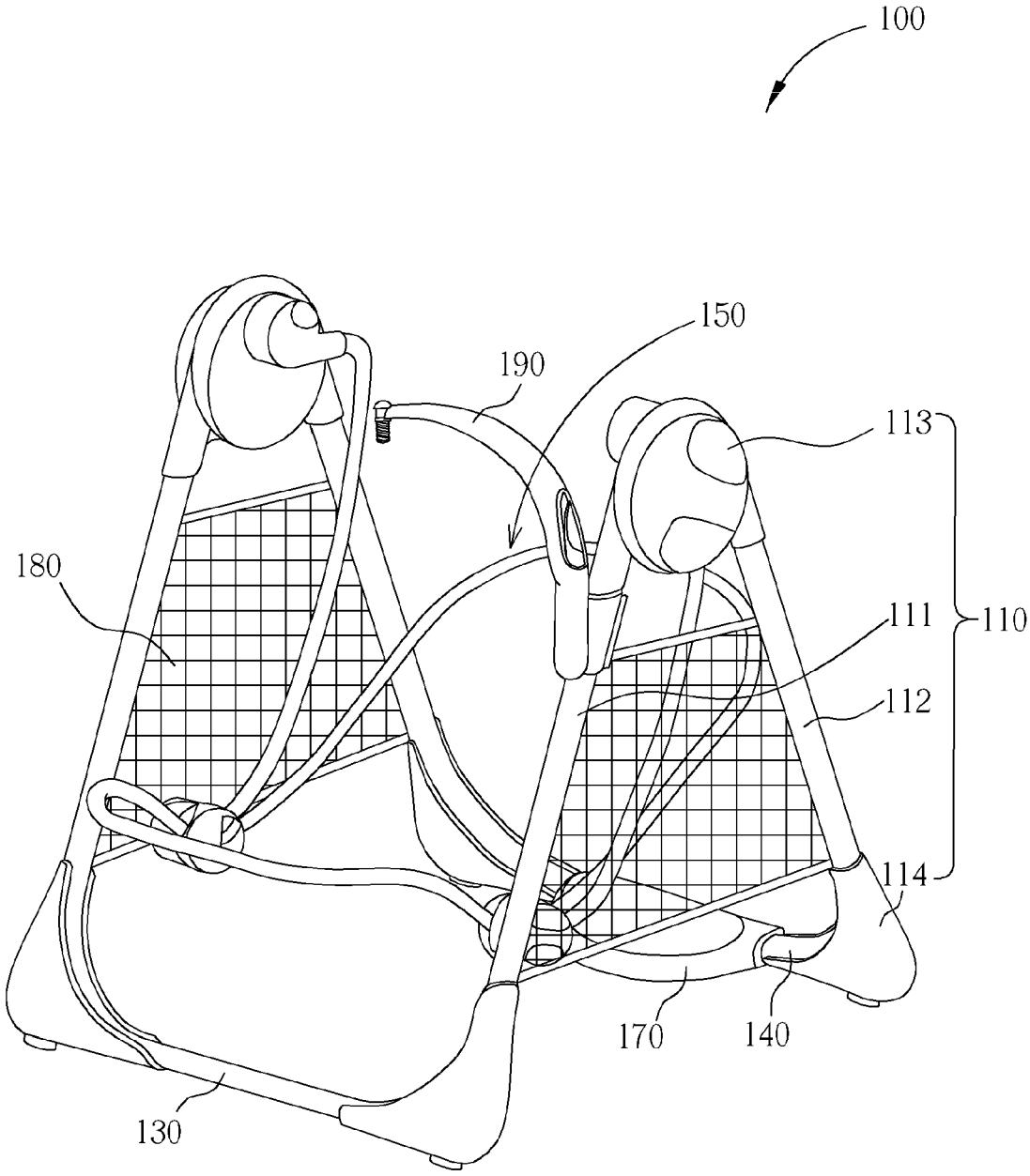
FIG. 2 is an illustration of an infant swing according to the present invention.

Please refer to FIG. 2. FIG. 2 is an illustration of an infant swing 100 according to the present invention. The infant swing 100 includes a frame body 110, a seat assembly 150, two protection guards 180, a driving module (not shown in the figure), a battery assembly 170, and a toy frame 190. The seat assembly 150 can support a seat for carrying an infant or a toddler. The frame body 110 includes a front leg frame 111, a rear leg frame 112, a connecting device 113, and a plurality of foot assemblies 114. In the embodiment, the front leg frame 111 and the rear leg frame 112 are pipes in the form of U-shape, which include a front bottom pipe 130 and a rear bottom pipe 140 respectively. The upper ends of the front leg frame 111 and the rear leg frame 112 pivot to each other via the connecting device 113. A folding module, which is not shown in the figure, is configured inside the connecting device 113 and allows the front leg frame 11 and the rear leg frame 112 of the frame body 110 for moving close to a folding status or moving away to an opened status. The frame body 110 in FIG. 2 is set in the opened status such that a toddler can sit on a seat. In other embodiments of the present invention, the front leg frame 111 and the rear leg frame 112 can also be of other forms. For example, the front leg frame can include a pair of front connecting legs and a front bottom pipe connecting to the two front connecting legs to form a similar U-shape structure as shown in the embodiment in FIG. 2. The rear leg frame can also include a pair of rear connecting legs and a rear bottom pipe connecting to the two rear connecting legs to form a similar U-shape structure as shown in the embodiment in FIG. 2. The front leg frame and the rear leg frame in the invention can be a monolithic U-shape frame or a frame assembly composed by some separate components.

Figure 3:
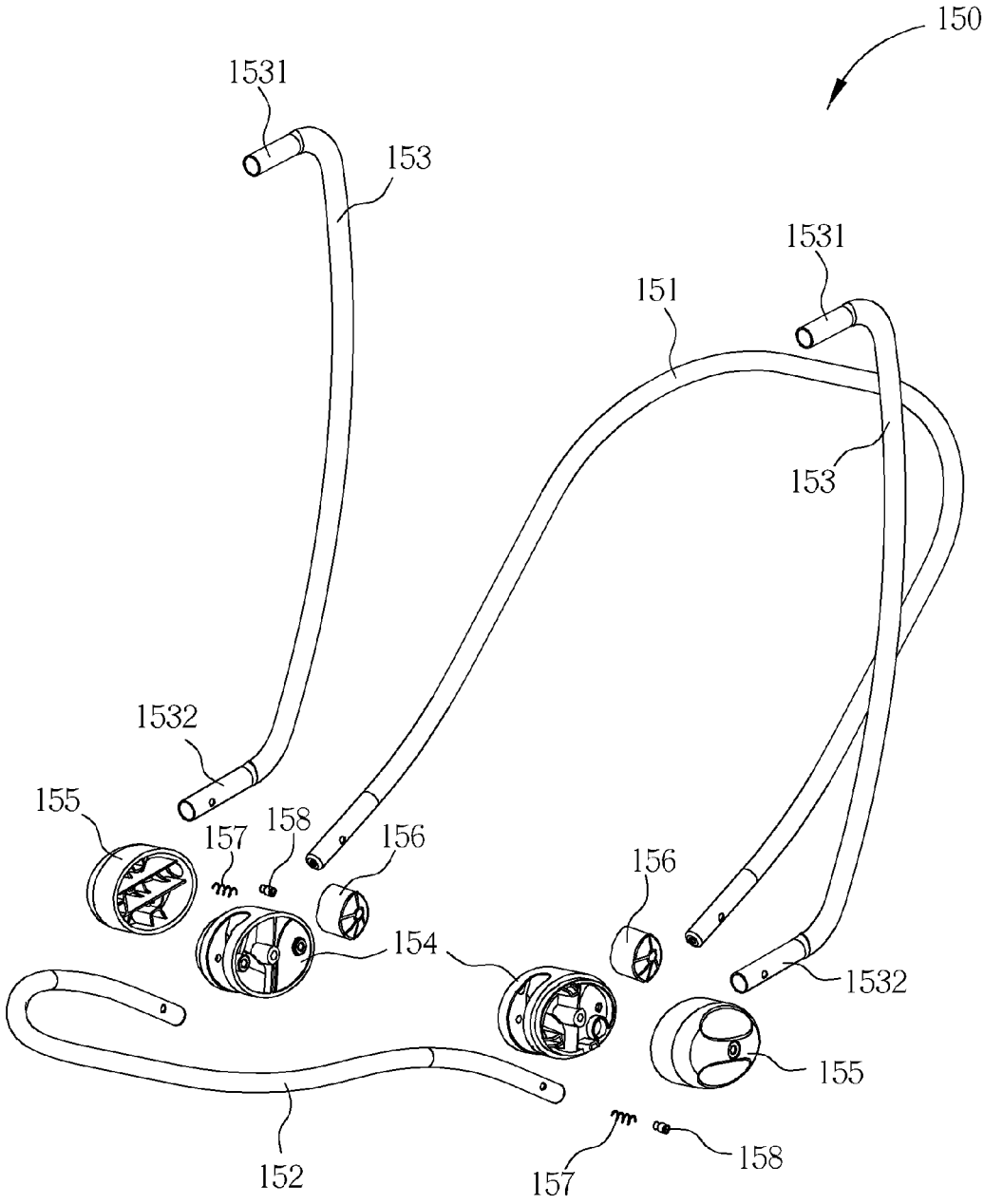
FIG. 3 is an illustration of each components of the seat assembly of the infant swing.
Figure 4:
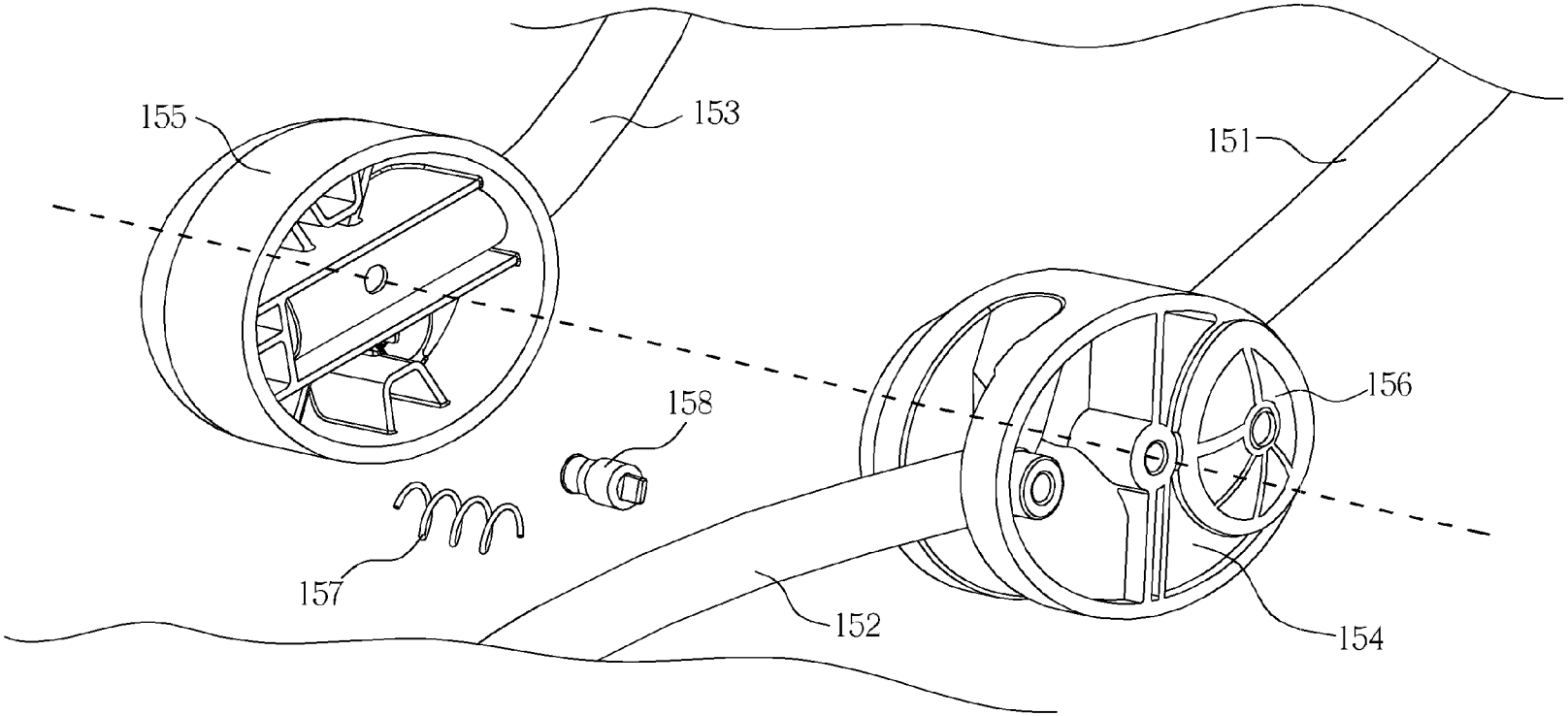
FIG. 4 is an illustration of the pivot of the foldable seat assembly.
Figure 5:
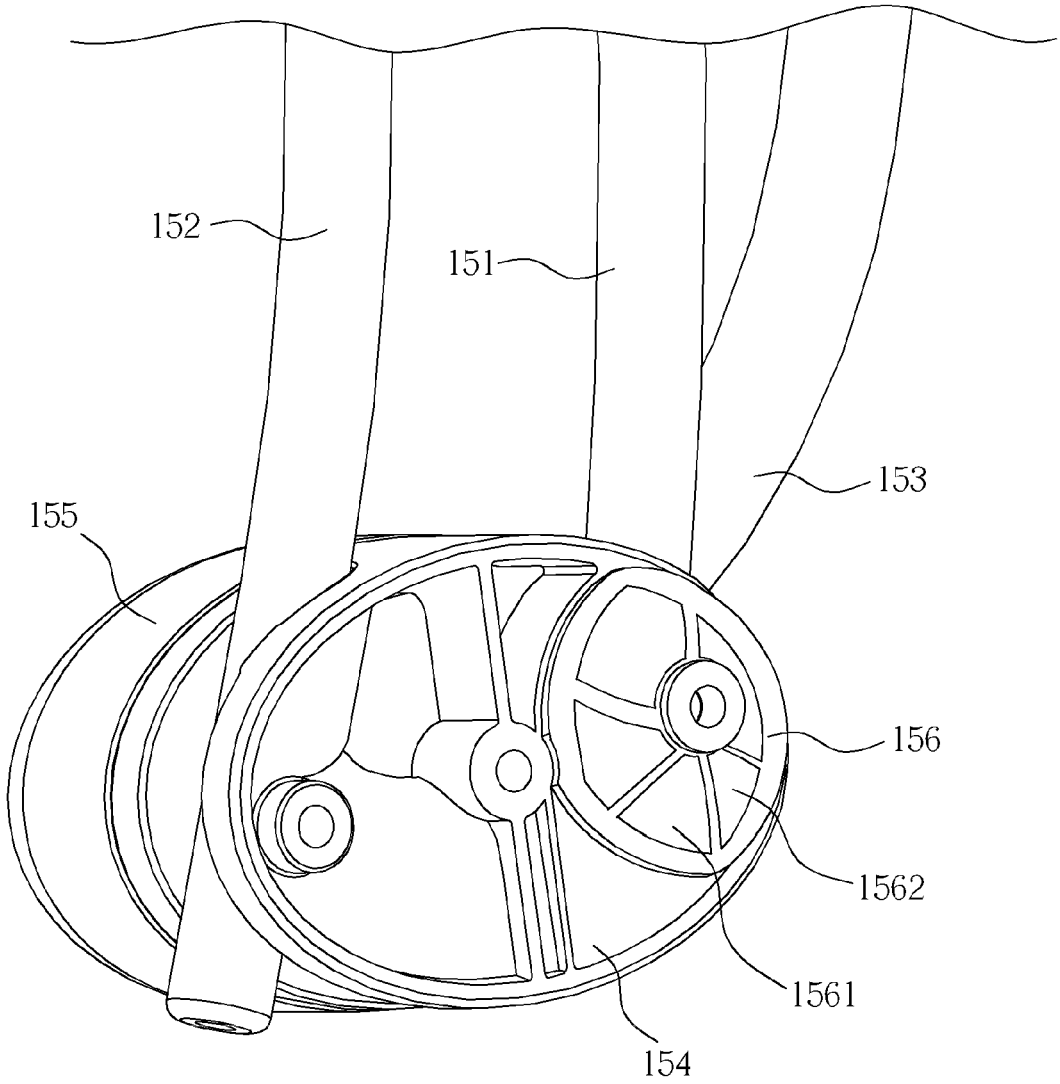
FIG. 5 is an illustration of the folding pivot of the seat assembly.

Please also refer to FIG. 3, which shows an illustration of each components of the seat assembly 150 of the infant swing 100. The seat assembly 150 includes a backrest unit 151, a sitting unit 152, two hanging arms 153, and two connecting units (each composed by a first connecting seat 154, a second connecting seat 155, a rotary unit 156, a spring 157, and an adjusting unit 158). The sitting unit 152 and the backrest unit 151 pivot to each other via the first connecting seat 154 in the seat assembly 150 and are capable of holding a seat cushion and a backrest cushion respectively, or holding an infant seat thereon, to provide room for an infant/toddler to sit. FIG. 4 shows how the backrest unit 151 connects to the sitting unit 152 and how the seat assembly 150 is put together. The backrest unit 151 first connects to the rotary unit 156 and then the rotary unit 156 is pivotally configured on the first connecting seat 154. The spring 157 and the adjusting unit 158 are configured between the second connecting seat 155 and the first connecting seat 154 so that the adjusting unit 158 can detachably engage with one of the notches of the rotary unit 156. In the embodiment, the rotary unit 156 has a first notch 1561 and a second notch 1562 that can respectively locate the backrest unit 151 in a closed status and in an opened status by the adjusting unit 158 as shown in FIG. 5. When the frame body 110 folds to the folded status, the sitting unit 152 and the backrest unit 151 can be operated to pivot to each other to what is shown in FIG. 5 via the first connecting seat 154 to decrease the folded size of the infant swing 100. A first end 1531 of the hanging arm 153 connects to the driving module inside the connecting device 113, which has a driving module therein, so that the hanging arm 153 is capable of swing relative to the frame body 110. A second end 1532 of the hanging arm 153 connects to the second connecting seat 155, which is further riveted to the first connecting seat 154 along the direction with dashed lines in FIG. 4 to form the connecting unit. As a result, the seat assembly 150 can then be brought to swing back and forth relative to the frame body 110 through the hanging arms 153.

Please go back and refer to FIG. 2. In the embodiment, the battery assembly 170 is configured at the bottom, or specifically the rear bottom pipe 140, of the rear leg frame 112. In this embodiment, the rear leg frame 112 is made of hollow pipe that can contain an electrical wire (not shown in the figure) for electrically connecting the battery assembly 170 and the driving module inside the connecting device 113. The battery assembly 170, which can also be configured at the bottom, or the front bottom pipe 130, of the front leg frame 111, is designed to provide power for the driving module through the electrical wire. The hanging arm 153 connecting to the driving module can then be droved to swing relative to the frame body 110 as the driving module is powered by the battery assembly 170 and moves the hanging arms 153.

Additionally, the hands of a toddler sitting on the infant swing 100 are very easily to be clipped and harmed by the hanging arms 153 and the leg frames 111, 112 when the infant swing 100 is swinging. In order to prevent the accident from happening, the infant swing 100 of the present invention further set two protection guards 180 between the front leg frame 111 and the rear leg frame 112 at both sides, as shown in FIG. 2. The protection guards 180 are flexible and generally made of soft material (such as clothe), connecting between the front leg frame 111 and the rear leg frame 112, and easily detached from the frame body 110 for cleaning purpose. When swinging back and forth relative to the frame body 110, the seat assembly 150, including the hanging arms 153, can move within the area between the two protection guards 180 and the protection guards 180 can effectively prevent the toddler from reaching his/her hands out between the front leg frame 111 (or the rear leg frame 112) and the hanging arms 153.

Figure 6:
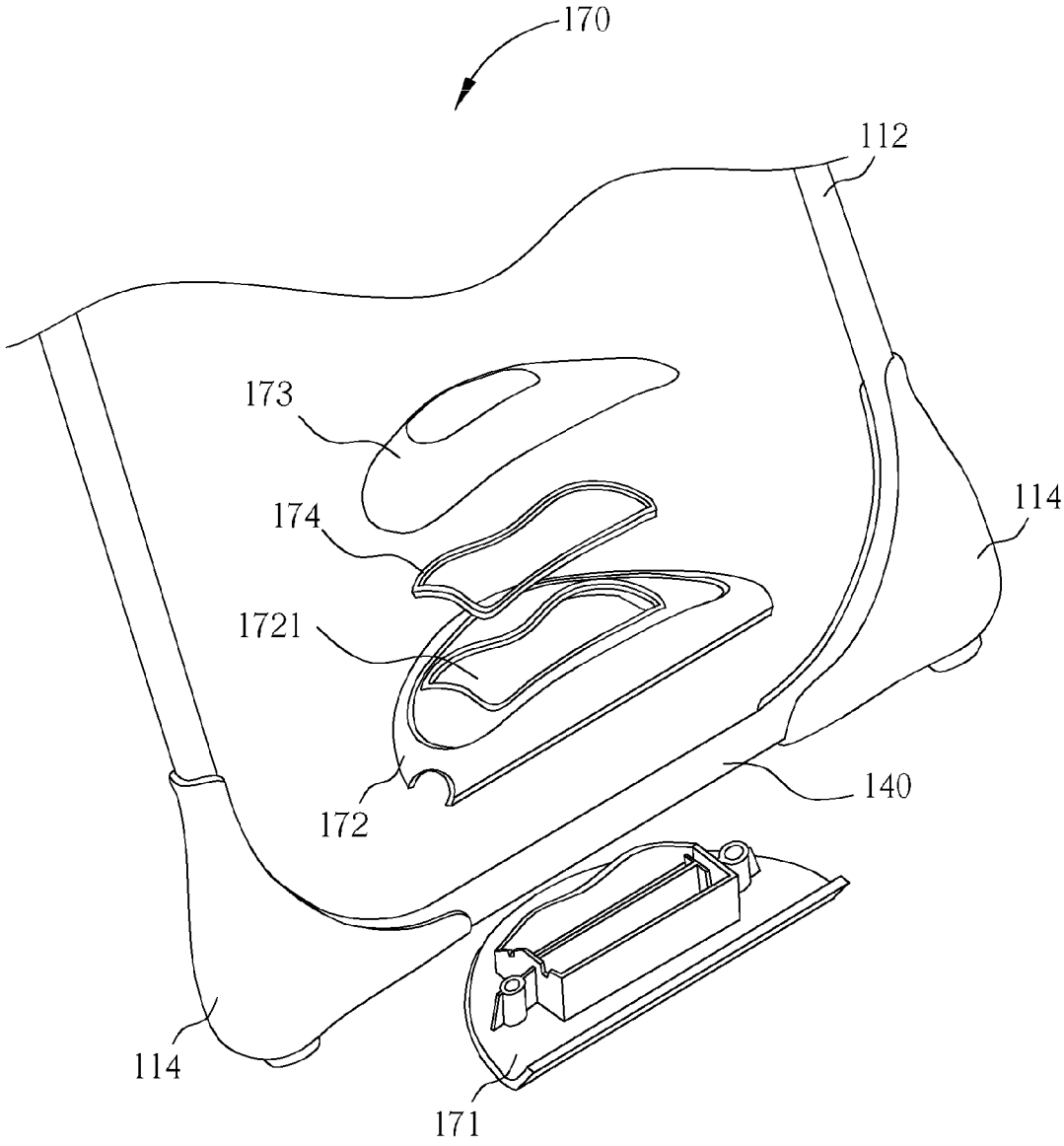
FIG. 6 is an illustration of a battery assembly.

The present invention also has a feature of configuring the battery assembly 170 at the bottom of the frame body 110. For example, it is configured at the rear bottom pipe 140 of the rear leg frame 112 in the embodiment, which significantly lowers the center of gravity of the infant swing 100 and significantly increases the stability when operating. Please refer to FIG. 6, which is an illustration of an embodiment of the battery assembly 170 disclosed in the present invention. The battery assembly 170 includes a box, including a top case 172 and a bottom case 171 that assemble together and mount on the rear bottom pipe 140, a cover 173, and a water-proof unit 174. The room between the top case 172 and the bottom case 171 can contain a battery, or batteries, and has electrical connection to the electrical wire. The top case 172 has an opening 1721 and the cover 173 can be detachably mounted to the opening 1721, while the water-proof unit 174 is configured around the opening 1721 to prevent moistures from permeating into the battery assembly 170 when the cover 173 is mounted to the opening 1721.

Figure 9:
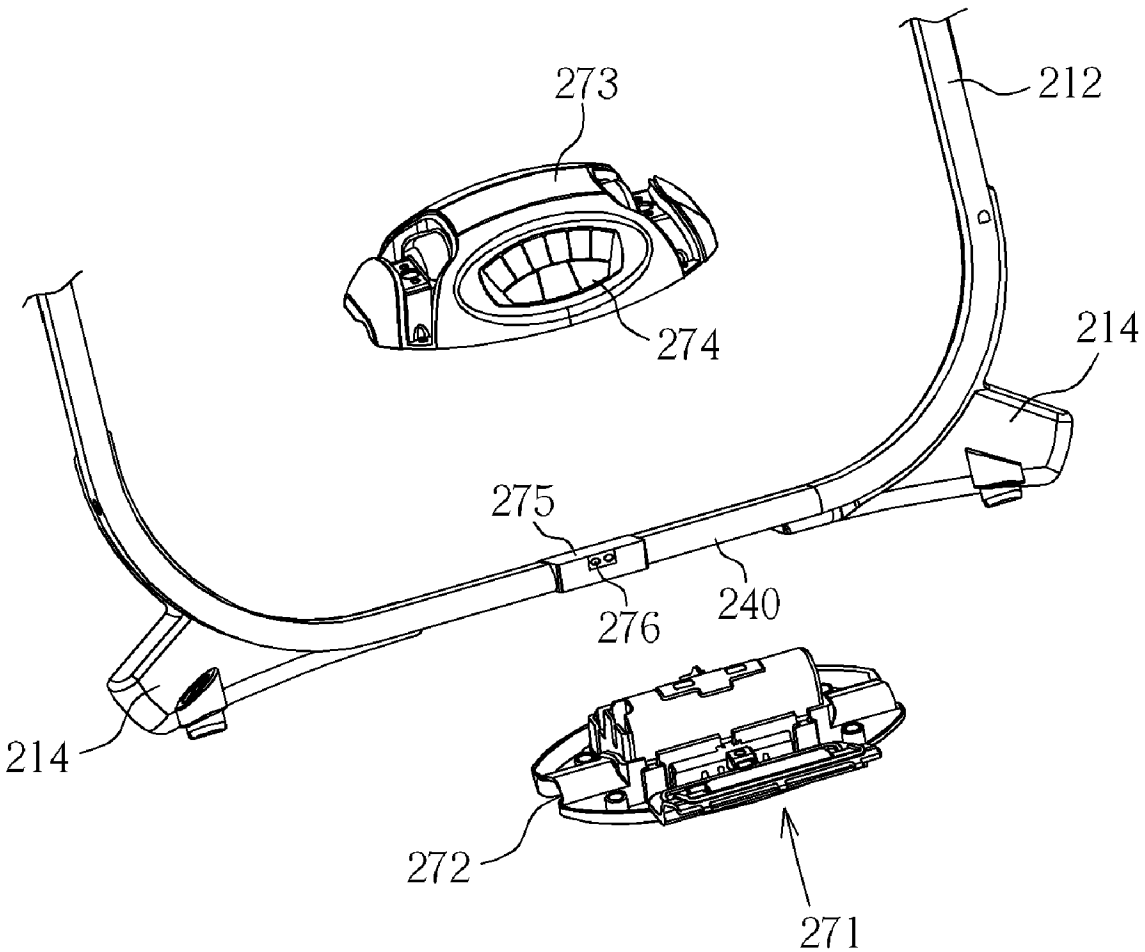
FIG. 9 is an illustration of another embodiment of the battery assembly.
Figure 10:
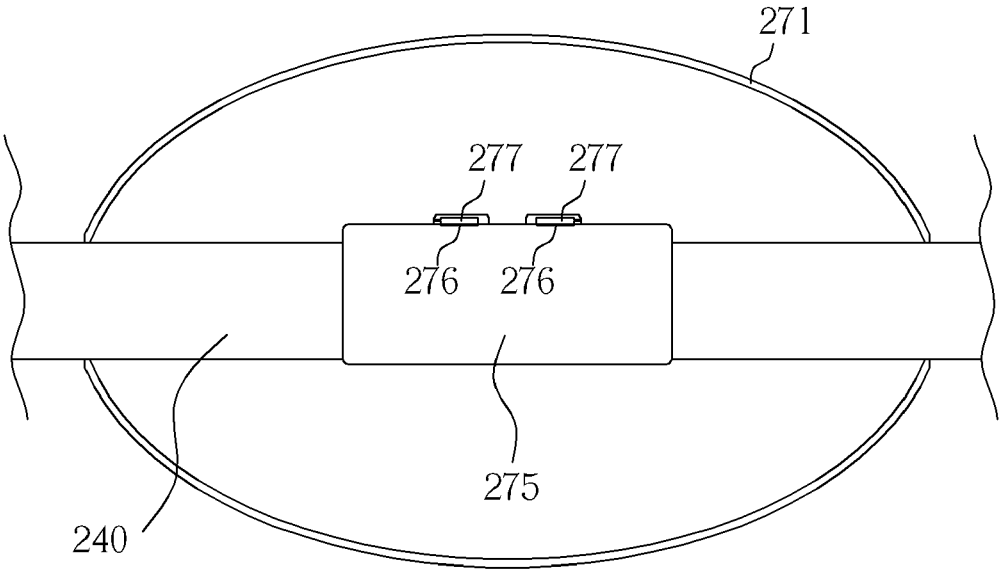
FIG. 10 is an illustration of the bottom view of the battery assembly in FIG. 9 mounted thereon.

The battery assembly can also be mounted at the bottom of the frame body in a detachable way. FIG. 9 shows a second embodiment of the battery assembly, which is composed by a cover 273, a battery base 271, and a mounting seat 275 that mounts at the rear bottom pipe 240. The battery assembly in this embodiment can be used as an individual module like a music box when detached from the infant swing. A control panel 274 on the cover 273 can access the individual module while detached and served as a music box. The battery base 271 has a channel 272 that can mount on the mounting seat 275 at the rear bottom pipe 240 of the rear leg frame 212. The mounting seat 275 has an electrical connection connecting to the driving module, such as electrical wires, passing through the hollow rear leg frame 212, and extensions of first connecting ends 276 thereon. FIG. 10 shows that the battery base 271 is mounted on the mounting seat 275. Second connecting ends 277 locating inside the channel 272 of the battery base 271 and electrically connecting to the battery of the battery base 271 can connect to the first connecting ends 277 of the mounting seat 275. In such way, the battery assembly can provide power for the driving module.

Figure 7:
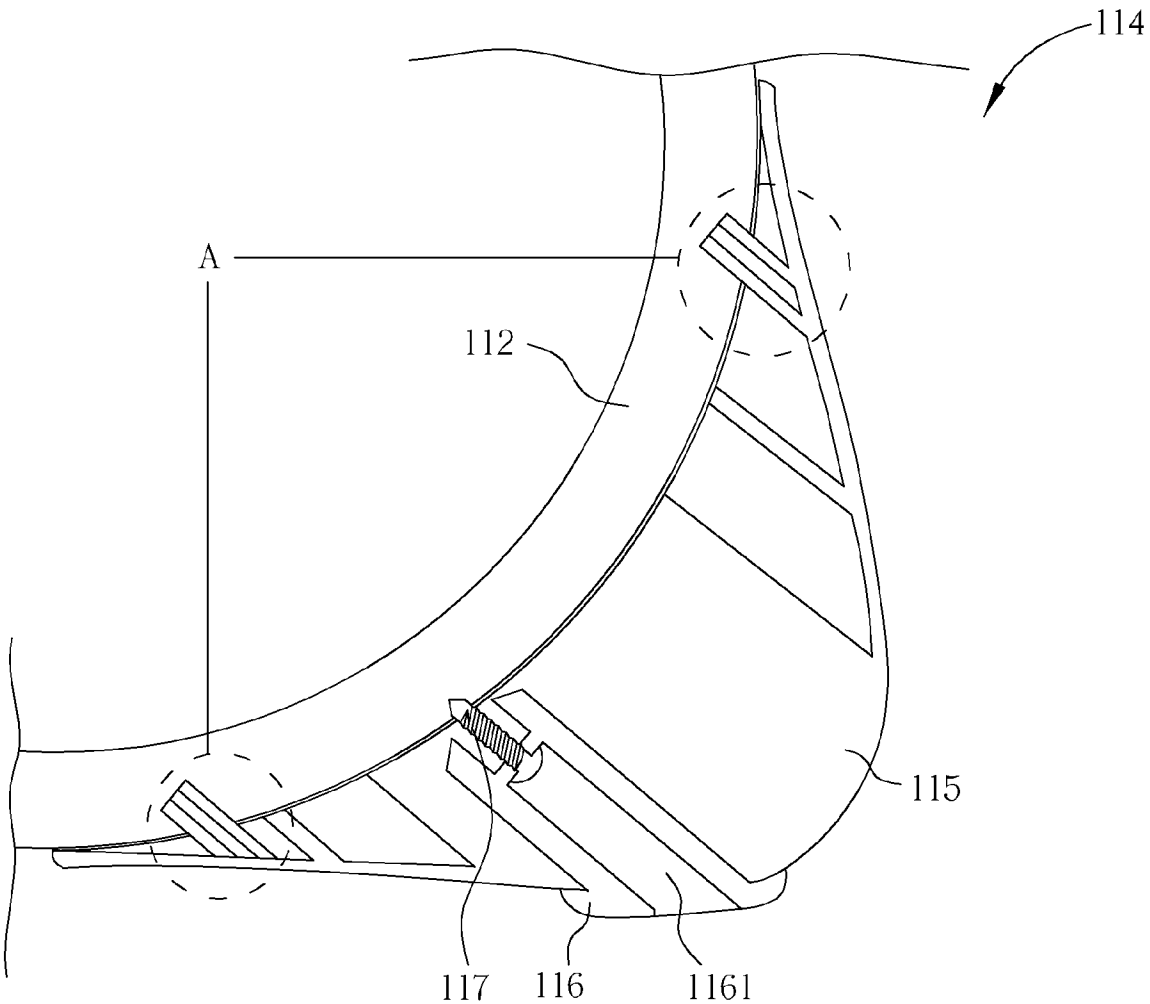
FIG. 7 is an illustration of a skidproof foot assembly.

Please refer to FIG. 7. To enhance the stability and provide an integrated outlook of the infant swing 100, a plurality of foot assemblies 114 are configured at the U-shape elbows of the front leg frame 111 and the rear leg frame 112. Each foot assembly 114 includes a foot body 115 and a skidproof piece 116. The section A of the foot body 115 can position with the elbow of the front leg frame 111 and the rear leg frame 112. The skidproof piece 116 is assembled to the foot body 115 and bulging outward the foot body 115 for preventing the front leg frame 111 and the rear leg frame 112 from slipping when placed on a support. A through hole 1161 on the skidproof piece 116 can further allow a screw 117 to fasten the skidproof piece 116 and the foot body 115 on the elbow of the front leg frame 111 and the rear leg frame 112. FIG. 9 shows a second embodiment of the foot assembly 214.

Figure 8:
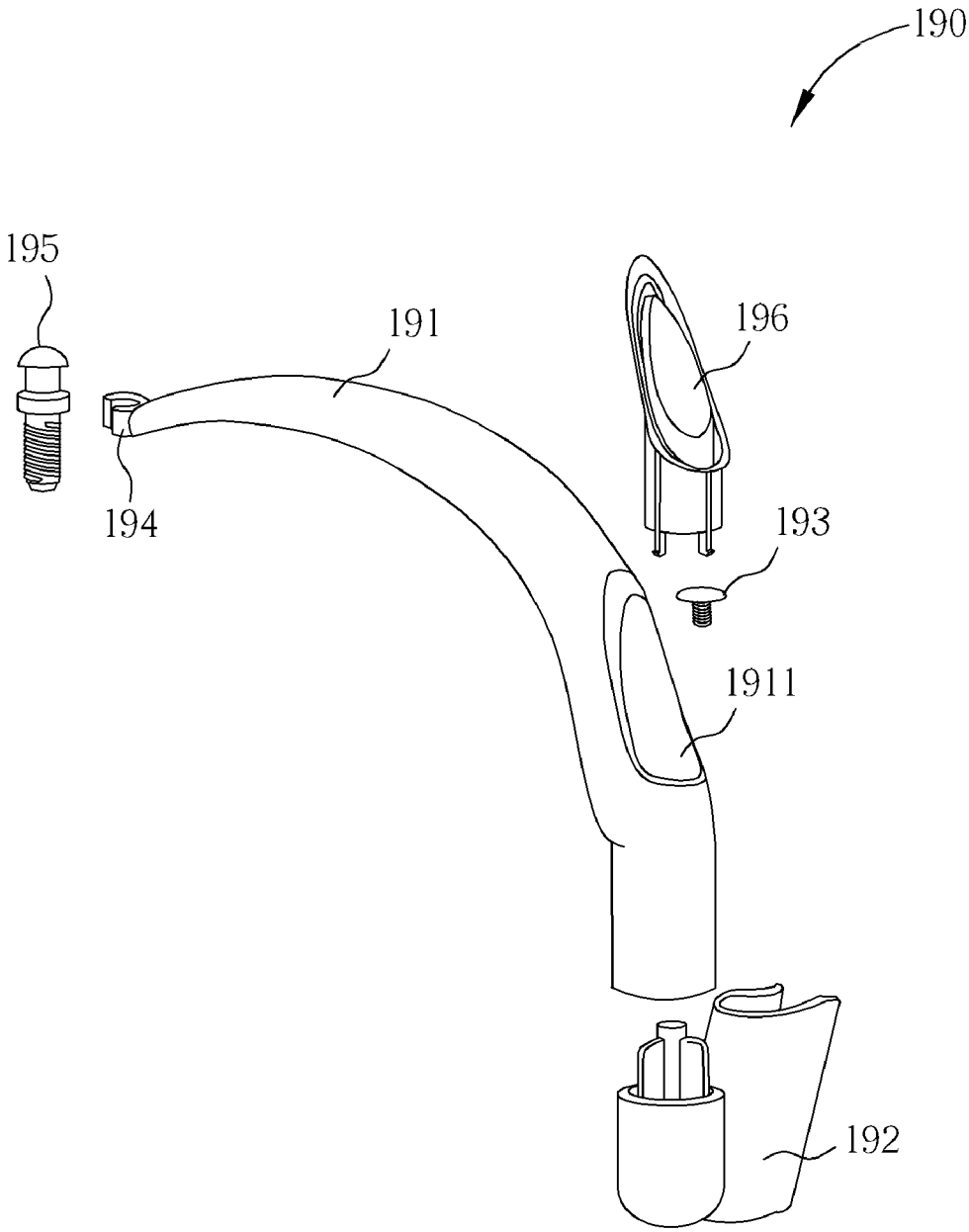
FIG. 8 is an illustration of a toy frame.

Please refer to FIG. 8. The infant swing 100 further includes a toy frame 190. In the embodiment, the toy frame 190 is mounted on the front leg frame 111, while mounting on the rear leg frame 112 is also an option, and capable of rotating relative to the front leg frame 111. The toy frame 190 can be detached from the front leg frame 111 when not in use. The toy frame 190 includes a body 191 and an engaging seat 192, which is rotatably mounted on the front leg frame 111. One end of the body 191 is detachably installed on the engaging seat 192, or more specifically in the embodiment, rotatably installed on the engaging seat 192 by fixing a screw 193 through a hole 1911 of the body 191 to the engaging seat 192. For providing better integration of the appearance, a cover 196 can cover on the hole 1911. The body 191 has a clamping apparatus 194 at the other end for holding a toy 195 on the body 191. The toy 195 holding on the toy frame 190 provides fun for the toddler when seating on the infant swing 100.

The infant swing disclosed in the present invention has frame body that includes a front leg frame and a rear leg frame pivoting to each other and connecting to a seat assembly via a driving module at the pivot between the front leg frame and the rear leg frame for swinging the seat assembly back and forth relative to the frame body. Two protection guards are mounted and connected between the front leg frame and the rear leg frame for preventing the toddler from be harmed when reaching his/her hands out between the frame body and the seat assembly as the toddler sits in the seat and swings relative to the frame body. The battery assembly that provides power for the driving module is configured at the bottom of the frame body for effectively lowering the center of gravity of the infant swing and providing higher stability for the infant swing. Additionally, the skidproof foot assemblies mounting at the elbows of the front leg frame and the rear leg frame also provide stability and integrity for the infant swing.

Those skilled in the art will readily observe that numerous modifications and alterations of the device and method may be made while retaining the teachings of the invention. Accordingly, the above disclosure should be construed as limited only by the metes and bounds of the appended claims.

The invention claimed is:

1. An infant swing, comprising:

a frame body comprising a front leg frame and a rear leg frame capable of pivoting to each other, each of the front leg frame and the rear leg frame comprising two connecting legs;

a seat assembly for supporting a seat and swingly connecting to the frame body, the seat assembly comprising:

a sitting unit for supporting the seat;

a backrest unit pivotally connecting to the sitting unit and movable relative to the sitting unit between an opened status and a closed status;

two connecting units, the sitting unit and the backrest unit pivoting to each other via the two connecting units, each connecting unit comprising a pivotable rotary unit, the backrest unit connected to the rotary unit and pivotable relative to the connecting unit and the sitting unit, the rotary unit comprising a plurality of notches;

two adjusting units, each configured at the connecting unit respectively for being inserted into one of the plurality of notches of the rotary unit so as to fix the rotary unit and the backrest unit to the connecting unit; and two hanging arms with one end connecting to the pivot of the front leg frame and the rear leg frame and the other end connecting to the two connecting units respectively for moving the seat assembly to swing relative to the frame body;

a driving module configured at the pivot of the front leg frame and the rear leg frame and connecting to the seat assembly for driving the seat assembly to swing relative to the frame body; and a flexible protection guard connecting between one connecting leg of the front leg frame and one connecting leg of the rear leg frame of the same side, and not moving with the seat assembly while the seat assembly swings relative to the frame body.

2. The infant swing of claim 1, wherein the frame body further comprises a connecting device, the front leg frame and the rear leg frame each connecting to the connecting device that allows the front leg frame and the rear leg frame for configuring in a status with an included angle.

3. The infant swing of claim 1, wherein each of the front leg frame and the rear leg frame comprises a bottom pipe that is detachably connecting between the corresponding two connecting legs, the infant swing further comprising a battery assembly configured at one of said bottom pipes of the front leg frame and the rear leg frame and electrically connecting to the driving module for providing power to the driving module to swing the seat assembly.

4. The infant swing of claim 1, wherein the front leg frame and the rear leg frame are U-shape pipes and the two connecting legs of each of the front leg frame and the rear leg frame are part of the corresponding U-shape pipe, the infant swing further comprising a battery assembly configured at the U-shape bottom of one of said front leg frame and said rear leg frame and electrically connecting to the driving module for providing power to the driving module to swing the seat assembly.

5. The infant swing of claim 4, wherein the frame body further comprises a plurality of foot assemblies, each configured at the U-shape bottom of the leg frames, each foot assembly comprising:

a foot body; and a skidproof piece bulging outward the foot body.

6. The infant swing of claim 1, wherein the flexible protection guard detachably connects between the front leg frame and the rear leg frame.

7. The infant swing of claim 1, further comprising a toy frame detachably configured at one of said leg frames and capable of rotating relative to the frame body.

8. An infant swing, comprising:

a frame body comprising a front leg frame and a rear leg frame capable of pivoting to each other, each of the front leg frame and the rear leg frame comprising two connecting legs;

a seat assembly for supporting a seat and swingly connecting to the frame body, the seat assembly comprising:

a sitting unit for supporting the seat;

a backrest unit pivotally connecting to the sitting unit and movable relative to the sitting unit between an opened status and a closed status;

two connecting units, the sitting unit and the backrest unit pivoting to each other via the two connecting units, each connecting unit comprising a pivotable rotary unit, the backrest unit connected to the rotary unit and pivotable relative to the connecting unit and the sitting unit, the rotary unit comprising a plurality of notches;

two adjusting units, each configured at the connecting unit respectively for being inserted into one of the plurality of notches of the rotary unit so as to fix the rotary unit and the backrest unit to the connecting unit; and two hanging arms with one end connecting to the pivot of the front leg frame and the rear leg frame and the other end connecting to the two connecting units respectively for moving the seat assembly to swing relative to the frame body;

a driving module configured at the pivot of the front leg frame and the rear leg frame and connecting to the seat assembly for driving the seat assembly to swing relative to the frame body;

a flexible protection guard connecting between one connecting leg of the front leg frame and one connecting leg of the rear leg frame of the same side, and not moving with the seat assembly while the seat assembly swings relative to the frame body; and a battery assembly configured at one of said leg frames and electrically connecting to the driving module for providing power to the driving module to swing the seat assembly.

9. The infant swing of claim 8, wherein the frame body further comprises a connecting device, the front leg frame and the rear leg frame each connecting to the connecting device that allows the front leg frame and the rear leg frame for configuring in a status with an included angle.

10. The infant swing of claim 8, wherein each of the front leg frame and the rear leg frame comprises a bottom pipe that is detachably connecting between the corresponding two connecting legs, and wherein the battery assembly is configured at one of said bottom pipes.

11. The infant swing of claim 8, wherein the front leg frame and the rear leg frame are U-shape pipes, the two connecting legs of each of the front leg frame and the rear leg frame are part of the corresponding U-shape pipe, and the battery assembly is configured at the U-shape bottom of one said leg frame.

12. The infant swing of claim 11, wherein the frame body further comprises a plurality of foot assemblies, each configured at the U-shape bottom of the leg frames, each foot assembly comprising:

a foot body; and a skidproof piece bulging outward the foot body.

13. The infant swing of claim 8, wherein the leg frames are hollow pipes and the battery assembly is electrically connecting to the driving module via a power conductor passing through the leg frame.

14. The infant swing of claim 8, wherein the battery assembly comprises:

a box mounted at the bottom of one said leg frame;

a cover detachably mounted on the box; and a water-proof unit configured between the cover and the box.

15. The infant swing of claim 8, wherein the battery assembly comprises:

a mounting seat configured at one said leg frame and electrically connecting to the driving module via a power conductor of the leg frame, the mounting seat comprising a first connecting end; and a battery base detachably mounted on the mounting seat and comprising a second connecting end for electrically connecting to the first connecting end and providing power for the driving module to swing the seat assembly when the battery base mounts on the mounting seat.

16. The infant swing of claim 8, wherein the flexible protection guard detachably connects between the front leg frame and the rear leg frame.

17. The infant swing of claim 8, further comprising a toy frame detachably configured at one of said leg frames and capable of rotating relative to the frame body.

* * * * *